US006811226B1

(12) United States Patent
Kamrath

(10) Patent No.: US 6,811,226 B1
(45) Date of Patent: Nov. 2, 2004

(54) FURNITURE ASSEMBLY

(76) Inventor: George Kamrath, 1531 Saginaw Pl., Riverside, CA (US) 92506

( * ) Notice: Subject to any disclaimer, the term of this patent is extended or adjusted under 35 U.S.C. 154(b) by 32 days.

(21) Appl. No.: 10/118,574

(22) Filed: Apr. 8, 2002

Related U.S. Application Data

(60) Provisional application No. 60/282,721, filed on Apr. 9, 2001.

(51) Int. Cl.[7] ..... A47C 7/00

(52) U.S. Cl. ..... 297/440.14; 297/248; 297/440.15; 297/440.16; 297/450.1

(58) Field of Search ..... 297/232, 248, 297/452.63, 440.14, 440.15, 440.16, 445.1, 450.1

(56) References Cited

U.S. PATENT DOCUMENTS

| | | | | |
|---|---|---|---|---|
| 359,790 A | * | 3/1887 | Knott | 297/452.63 X |
| 2,113,145 A | | 4/1938 | Van Wyck | |
| 3,271,076 A | * | 9/1966 | Smith | 297/452.63 X |
| 3,737,926 A | | 6/1973 | Hermanson | |
| 3,929,373 A | | 12/1975 | Gawlinski | |
| 4,299,423 A | * | 11/1981 | Saiger | 297/232 X |
| 4,620,747 A | | 11/1986 | Lemmon | |
| 4,804,224 A | * | 2/1989 | Stapf | 297/354.12 |
| 4,898,421 A | | 2/1990 | Brunn | |
| 5,120,071 A | | 6/1992 | Thibault et al. | |
| 5,425,567 A | | 6/1995 | Albecker, III | |
| 5,427,435 A | | 6/1995 | Yoder, Jr. | |
| 5,720,093 A | | 2/1998 | Yoder, Jr. | |
| 5,911,469 A | | 6/1999 | Young | |
| 6,003,946 A | | 12/1999 | Jackson | |
| D425,719 S | | 5/2000 | Chalmers et al. | |
| 6,139,110 A | * | 10/2000 | Jeng | 297/452.39 |

* cited by examiner

*Primary Examiner*—Anthony D. Barfield
(74) *Attorney, Agent, or Firm*—Knobbe, Martens, Olson & Bear, LLP

(57) ABSTRACT

A modular furniture assembly is disclosed with an improved structural design that increases the structural stability of the modular furniture assembly by using triangulated support structures. In addition, the disclosed furniture assembly is designed with few adjustable parts in a manner such that a furniture user may rapidly and easily assemble the furniture assembly and adjust it to a desired configuration without requiring specialized tools or specialized knowledge.

36 Claims, 14 Drawing Sheets

FURNITURE ASSEMBLY

RELATED APPLICATIONS

This application claims the benefit of U.S. Provisional Application No. 60/282,721, filed on Apr. 9, 2001.

BACKGROUND OF THE INVENTION

1. Field of the Invention

The present invention relates to furniture and, in particular, concerns an efficient design for a wooden chair or bench that is adjustable and which may be disassembled for more efficient shipping and storage.

2. Description of the Related Art

Furniture is a necessary accoutrement to every home. Many homes that have outdoor patio facilities will also have specially designed patio furniture positioned on the patio for the comfort of the residents. Typically, outdoor patio furniture is made of fairly robust material and is generally selected to be made from a material that will have a pleasing appearance. One common type of furniture that is used in patio applications, as well as for indoor use, is heavy-duty wood furniture. One type of wood furniture that is commonly used in patio applications is redwood furniture as it presents a generally pleasing, rustic appearance. However, any of a number of different types of wood materials may be used to form furniture.

As patio furniture is generally positioned outside and is exposed to the elements, the size of the members forming the furniture is often larger than the components that form indoor furniture. The larger size of the pieces of wood used to form the furniture makes the furniture more resistant to the effects of exposure to the elements. Unfortunately, the use of these larger elements typically results in the patio furniture being heavy and somewhat bulky. Moreover, the more robust construction techniques used to form patio furniture often results in the patio furniture being non-adjustable. With larger wooden members, it is often difficult to implement a degree of adjustability in the furniture. However, different people who sit on the patio furniture may desire a different configuration of the furniture.

For example, it is often desirable to be able to adjust the angle with which the seat portion of a chair or bench is positioned with respect to the ground. However, with most pieces of patio furniture that are made out of wood, it is difficult, if not impossible, to adjust the angle of the seat to accommodate the desires of different users.

A further difficulty that occurs in many types of wooden furniture is that the furniture is often bulky and difficult to ship or store. As fairly large wooden members are used and assembled into fairly rigid structures to give the pieces of furniture greater strength to resist exposure to the weather, these pieces of furniture oftentimes have to be shipped or stored in an assembled form. However, pieces of furniture that are shipped or stored in an assembled form are often quite bulky, which greatly increases the shipping or storage cost of the piece of furniture.

Moreover, even those pieces of furniture that are designed to be disassembled for shipment or storage are often very difficult to reassemble. A typical homeowner who purchases a disassembled piece of patio furniture must either spend a considerable amount of time figuring out how to assemble all of the components, which may require the use of specialized tools, or have the piece of furniture assembled for them.

From the foregoing, it will be appreciated that there is a continuing need for heavy-duty wooden furniture, such as furniture that is suitable for use as patio furniture, that is adjustable, able to be disassembled for shipping and easily reassembled.

SUMMARY OF THE INVENTION

The aforementioned needs are satisfied by the furniture assembly of the present invention, which in one embodiment comprises a first and second seat support member, and a first and second back support member that are attached by means of a lap joint to the first and second seat support members at a midpoint such that first and second ends of the seat support members extend behind the back support members. The furniture assembly also comprises a plurality of covering members that are mounted to an outer face of the first and second seat support members and the first and second back support members so as to extend therebetween to define the seat and back surface of the furniture assembly. In this aspect, the furniture assembly also includes a first and second front post that are respectively pivotally attached to the front ends of the first and second seat support members such that the seat support members may pivot with respect to the first and second front posts, and a first and second rear post that are attached to the extending ends of the first and second seat support members and are also attached to an outer surface of the first and second back support members.

In the preferred embodiment, the seat support members are attached to the back support member by a lap joint that defines a cut out and a ledge that results in the back support members resting on the seat support members and thereby being inhibited from falling downward. This results in an interconnection between the back supports and the seat supports that provide for a fixed angular relationship between the back support and the seat supports that locks to the backrest and inhibits unstable sideways stability. However, the side and seat support members have to be connected provisionally before the plurality of covering members are attached, the provisional attachment is removed following installation of the seat covering members which provide the sideways support. Moreover, the front and rear posts may be installed in an angular manner with respect to the ground to provide additional forward and backward stability.

Since the rear posts are attached to both the ends of the seat support members and the back support members, a triangulated structure is thereby defined by the extended seat support members, the back support members and the rear posts, thereby providing additional support and stability for the furniture. Moreover, in this aspect, the extending ends of the seat support member and the upper ends of the rear post may be attached to the seat support members and the back support members, respectively, along a plurality of locations. This allows a seat and back portion of the furniture, as defined by the respective support members, to be pivoted with respect to the front posts such that the furniture may be assembled in one of a plurality of different orientations.

Hence, the furniture, when assembled, is sturdy but may be assembled into a plurality of different configurations to accommodate different users. In one particular embodiment, the furniture assembly also comprises a pair of arm supports that extend between the upper surface of both the front and rear posts which also results in the front posts being inhibited from pivoting, thereby restraining the front posts at a fixed position relative to the ground.

In another embodiment, the chair assembly has a horizontally extending back member that extends between the first and second seat support members at the rear of the first and second seat support members such that back surface members may be extended in a direction perpendicular to the ground to achieve a different aesthetic appearance. In yet another embodiment, the piece of furniture is elongate with a center support structure so as to define a bench. Hence, the piece of furniture of the present invention is sturdy, due to the triangulated structure, but may also be assembled in a plurality of different angular orientations to accommodate different users.

In another aspect, the piece of furniture may be readily disassembled for easy shipment or storage by removing the back support members from the seat support members such that the two resulting pieces are two planar pieces of the chair that may be stacked on top of each other. The front and rear posts may then be removed from the piece of furniture so as to be able to be stacked on the seat and back sections of the chair. Hence, the configuration of the piece of furniture of the present invention allows for more compact storage and shipment and easy assembly.

In still another embodiment, the furniture assembly may be configured to comprise a modular bench having at least four legs that may be configured to support the weight of one or more seated individuals. In addition, the modular bench may include an elongated seat section having a plurality of seat support members, wherein a first seat support member is distally spaced from a second seat support member. The modular bench may further include an elongated back section having a plurality of back support members, wherein a first back support member is attached to the first seat support member in a manner so as to form a first lap joint interconnection, and wherein a second back support member is attached to the second seat support member in a manner so as to form a second lap joint interconnection. In one aspect, the first and second lap joint interconnections result in a fixed angular orientation between the seat support members and the back support members so as to form the modular bench with enhanced strength and stability.

In yet another embodiment, the furniture assembly may be configured to comprise another embodiment of a modular bench having at least two front legs and at least two rear legs, wherein the modular bench may include an elongated seat section having a plurality of seat support members. A first seat support member may be attached to first front leg and a first rear leg and distally spaced from a second seat support member that is attached to a second front leg and a second rear leg. The modular bench may further include an elongated back section having a plurality of back support members, wherein a first back support member is attached to the first seat support member and the first rear leg in a manner so as to form a first triangulated interconnection. A second back support member may then be attached to the second seat support member and the second rear leg in a manner so as to form a second triangulated interconnection. In one aspect, the first and second triangulated interconnections may result in a fixed angular orientation between the seat support members and the back support members so as to form the modular bench with improved structural stability.

Furthermore, a method of assembling furniture is disclosed herein. In one embodiment, the method of assembling furniture may comprise forming a seat and back section by temporarily attaching a first seat support member to a first back support member using temporary fasteners so as to form a first support component with a first lap joint interconnection and temporarily attaching a second seat support member to a second back support member using additional temporary fasteners so as to form a second support component with a second lap joint interconnection. The method may further comprise distally spacing the first support component from the second support component in a substantially parallel manner, attaching seat covering members to the upper portion of the first and second seat support members so as to form the seat section, attaching back covering members to the upper portion of the first and second back support members so as to form the back section, and removing the temporary fasteners including the additional temporary fasteners.

Additionally, the method may further comprise attaching at least four legs to the seat and back sections, wherein first and second front legs are attached to the front ends of the first and second seat support members. A first rear leg is attached to the rear end of the first seat support member and to the first back support member so as to form a first triangulated support structure, and a second rear leg is attached to the rear end of the second seat support member and to the second back support member so as to form a second triangulated support structure.

These and other objects and advantages of the present invention will become more apparent from the following description taken in conjunction with the accompanying drawings.

DETAILED DESCRIPTION OF THE PREFERRED EMBODIMENT

Figure 1A:
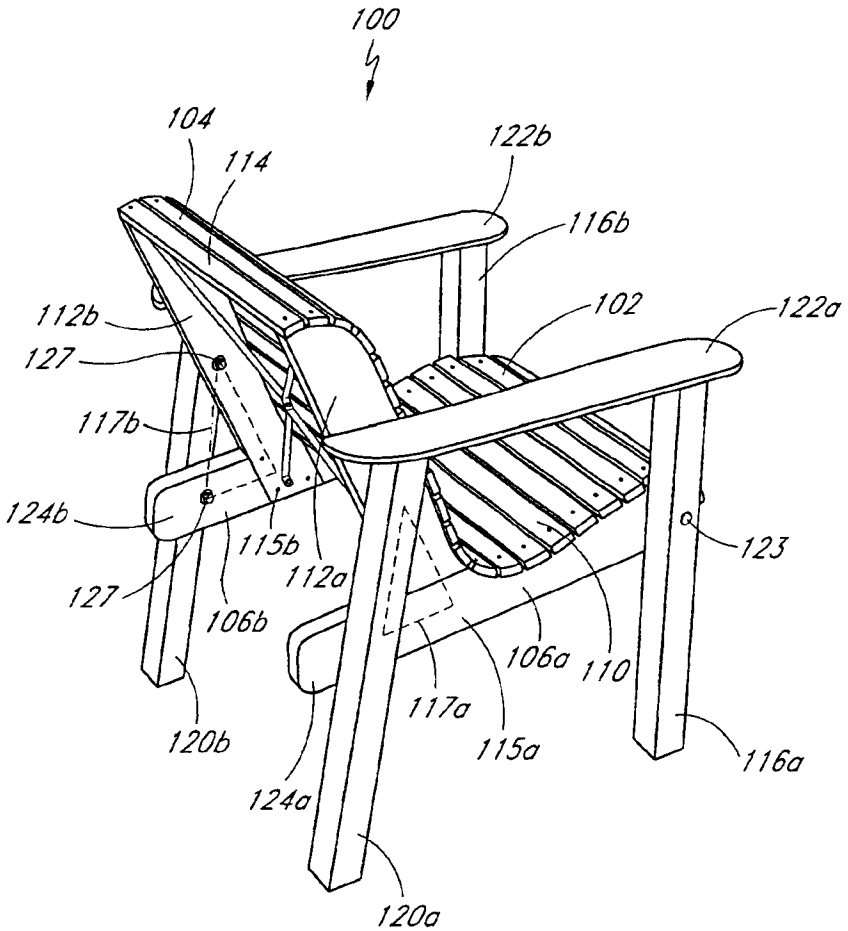
FIG. 1A is a side perspective view of one embodiment of a furniture assembly of the present invention.
Figure 1B:
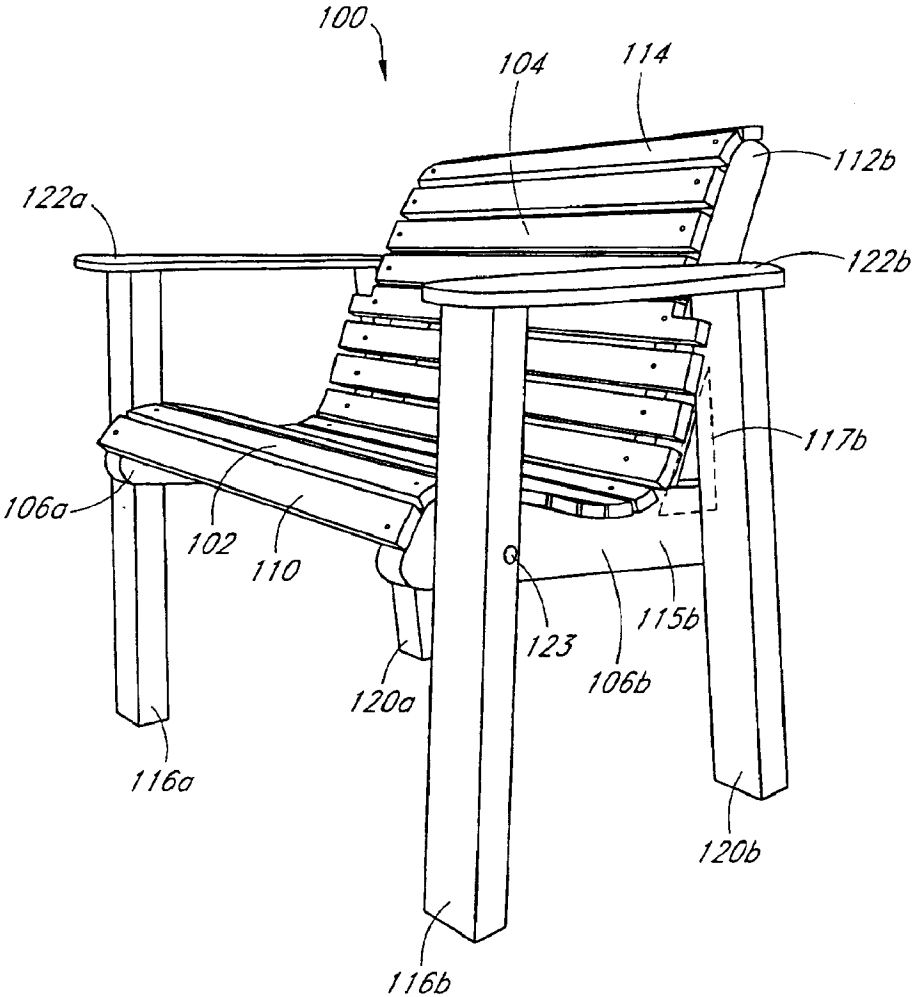
FIG. 1B is a front perspective view of the furniture assembly of FIG. 1A.
Figure 1C:
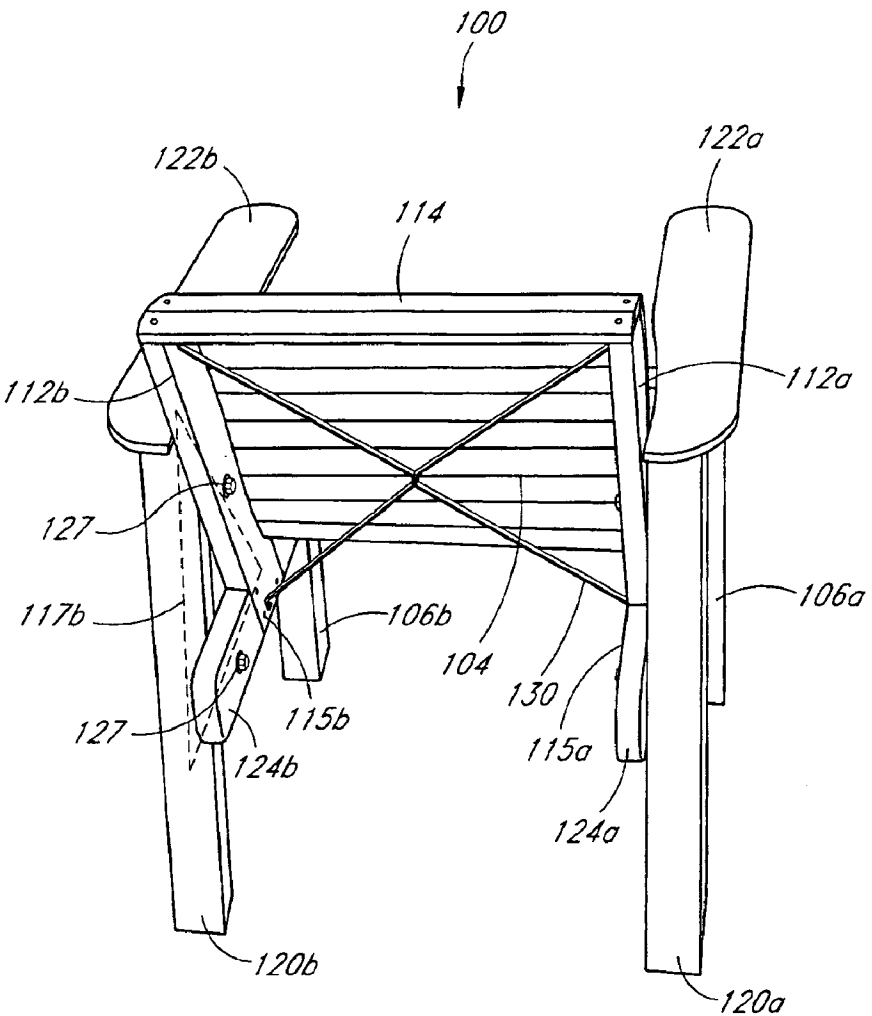
FIG. 1C is a rear perspective view of the piece of furniture of FIG. 1A.

Reference will now be made to the drawings wherein like numerals refer to like parts throughout. Referring initially to FIGS. 1A–1C, one embodiment of a furniture assembly 100 of the present invention is illustrated. In this particular embodiment, the furniture assembly 100 comprises a piece of furniture, such as a chair. As is illustrated in FIGS.

1A–1C, the furniture assembly 100 includes a seat section 102 and a back section 104. As is also illustrated in FIGS. 1A–1C, the seat and back sections 102, 104 may be connected together so as to define a seat upon which a user may sit.

In addition, the seat section 102 may include at least two seat support members 106*a*, 106*b* that may be positioned in a substantially parallel manner. The seat section 102 may also include a plurality of horizontal seat covering members 110 that extend between the first and second seat support members 106*a*, 106*b*. Similarly, the back section 104 may also include two back support members 112*a*, 112*b* with the plurality of horizontal back covering members 114 extending therebetween.

Moreover, the furniture assembly 100 may also include two front posts or front legs 116*a*, 116*b* that may be pivotally attached via attachment devices 123, such as nuts and bolts, to the front portions of the seat support members 106*a*, 106*b*, respectively, in a manner that will be described in greater detail below. The furniture assembly 100 may also include two rear posts or rear legs 120*a*, 120*b* that may be attached via attachment devices 127, such as nuts and bolts, to both the seat support members 106*a*, 106*b* and the back support members 112*a*, 112*b*, respectively, in a manner that will be described in greater detail below. Additionally, the furniture assembly 100 may also include two armrests 122*a*, 122*b* that extend from the upper surfaces of the front posts 116*a*, 116*b* to the rear posts 120*a*, 120*b* in the manner shown in FIGS. 1A–1C.

Furthermore, additional structural support may be provided to the furniture assembly 100 by using a metallic cross-brace 130 that may be mounted to the interior surfaces at four corners of the back support members 112*a*, 112*b* so as to define an x-shaped interlocking support structure. The metallic cross-brace 130 will be described in greater detail herein below with reference to FIG. 4.

Figure 2:
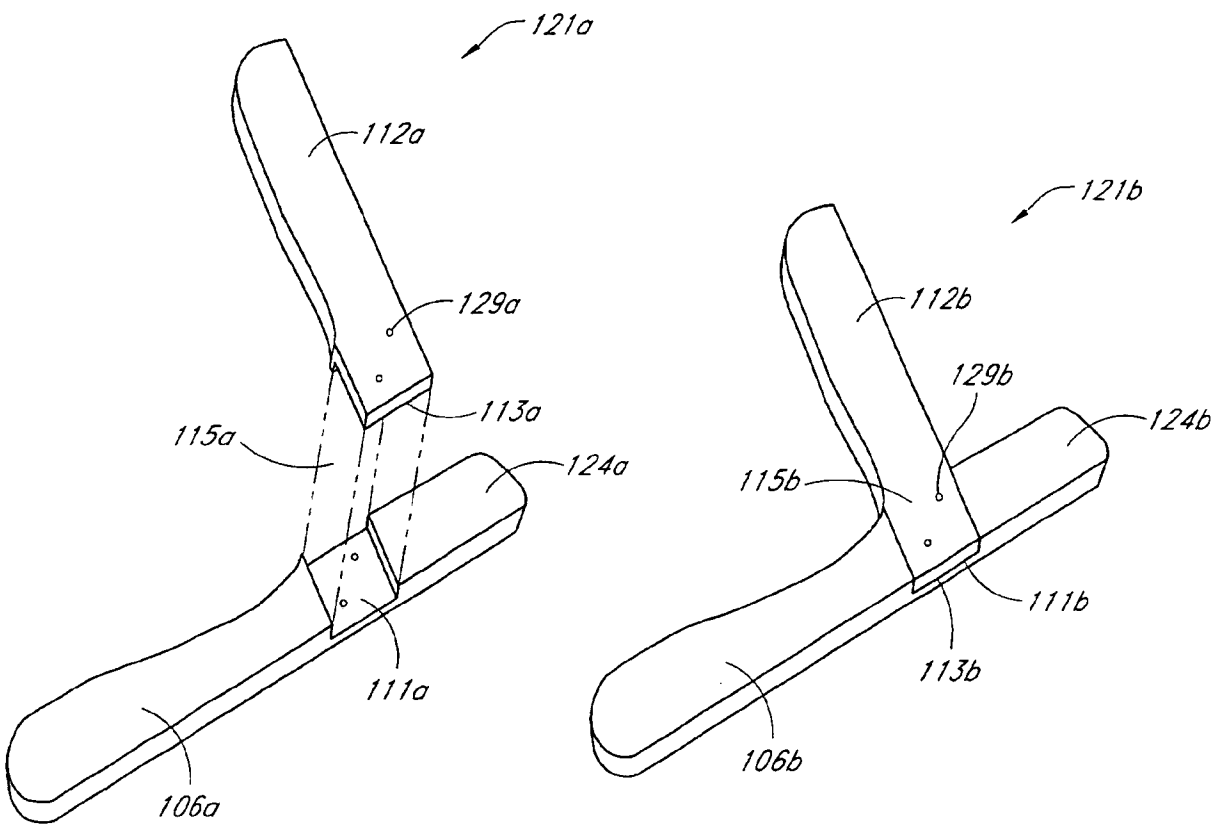
FIG. 2 is an illustration of the interconnection between two seat support members and two back support members of the furniture assembly of FIG. 1A.

Referring now to FIG. 2, an interconnection between the seat support members 106*a*, 106*b* and the back support members 112*a*, 112*b* are illustrated with a first and second lap joint interconnection 115*a*, 115*b*, respectively. Specifically, the back support members 112*a*, 122*b* may be attached at a point between the front and back ends of the seat support members 106*a*, 106*b* and extend upward therefrom. In one aspect, the seat support members 106*a*, 106*b* define a first and second lap joint recess 111*a*, 111*b* into which a first and second slotted section 113*a*, 113*b* of the back support members 112*a*, 112*b* may be received. The lap joint recesses 111*a*, 111*b* and the slotted sections 113*a*, 113*b* are preferably smaller in thickness than the remaining portion of the seat support members 106*a*, 106*b* and the back support members 112*a*, 112*b*, respectively. In addition, the slotted sections 113*a*, 113*b* may be supported by the upper surfaces of the seat support members 106*a*, 106*b* in a manner such that the lap joint interconnections 115*a*, 115*b* resist movement.

Prior to positioning the back covering members 114 onto the back support members 112*a*, 112*b* and the seat support members 106*a*, 106*b*, the back support members 112*a*, 112*b* and the seat support members 106*a*, 106*b* must be temporarily attached to each other using fasteners 129*a*, 129*b*, such as screws, in the manner shown in FIG. 2. However, once the seat and back covering members 110, 114 are attached thereby interconnecting the seat support members 106*a*, 106*b* and the back support members 112*a*, 112*b*, the temporary fasteners may be removed. Following, the furniture assembly 100 may then be assembled in a simple fashion by positioning the slotted sections 113*a*, 113*b* of the back support members 112*a*, 112*b* into the lap joint recesses 111*a*, 111*b* of the seat support member 106*a*, 106*b* to thereby define the lap joint interconnections 115*a*, 115*b*.

In one aspect, attaching the first seat support member 106*a* to the first back support member 112*a* produces a first support component 121*a*, and attaching the second seat support member 106*b* to the second back support member 112*b* produces a second support component 121*b*. When assembling the seat and back sections 102, 104, the first and second support components 121*a*, 121*b* are distally spaced in a parallel manner and the seat and back covering members 110, 114 are attached to the upper portions of the first and second support components 121*a*, 121*b* in a manner so as to form the seat and back surfaces of the furniture assembly 100.

Once the lap joint interconnections 115*a*, 115*b* are assembled, the extending sections 124*a*, 124*b* of the seat support members 106 are attached to the rear posts 120*a*, 120*b*, and the upper ends of the rear posts 120*a*, 120*b* are attached to the back support members 112*a*, 112*b*, the temporary interconnection between the seat support members 106*a*, 106*b* and the back support members 112*a*, 112*b* may be removed. Additionally, it should be appreciated that the lap joint interconnections 115*a*, 115*b* result in a fixed angular orientation between the seat support members 106*a*, 106*b* and the back support members 112*a*, 112*b*, which may provide greater lateral and/or sideways stability. The lap joint interconnections 115*a*, 115*b* may also provide greater rigidity and inflexibility for a seated individual sitting in the furniture assembly 100.

Attachment of the back support members 112*a*, 112*b* to the seat support members 106*a*, 106*b* in this fashion results in ends 124*a*, 124*b* of the seat support members 106*a*, 106*b* extending backwards beyond the back support members 112*a*, 112*b* in the manner shown in FIG. 2. As is shown in FIGS. 1A–1C, the rear posts 120*a*, 120*b* are preferably attached to both the ends 124*a*, 124*b* of the seat support members 106*a*, 106*b* and also to a mid-point along the back support members 112*a*, 112*b*. In this way, a first and second triangulated support structure 117*a*, 117*b* may be formed between the rear posts 120*a*, 120*b*, the seat support members 106*a*, 106*b* and the back support members 112*a*, 112*b*, respectively, which may provide greater stability for the furniture assembly 100.

In one aspect, as illustrated in FIGS. 1A–1C, the first back support member 112*a* may be attached to the first seat support member 106*a* and the first rear post 120*a* in a manner so as to form a first triangulated interconnection 117*a*. Similarly, the second back support member 112*b* may be attached to the second seat support member 106*b* and the second rear leg 120*b* in a manner so as to form a second triangulated interconnection 117*b*, and wherein the first and second triangulated interconnections 117*a*, 117*b* result in a fixed angular orientation between the seat support members 106*a*, 106*b* and the back support members 112*a*, 112*b* so as to form the chair 100 with improved structural stability, rigidity, and inflexibility.

In one embodiment, the ends 124*a*, 124*b* of the seat support members 106*a*, 106*b* may be attached at a plurality of different vertical locations along the rear posts 120*a*, 120*b*, respectively. Similarly, the upper ends of the rear posts 120*a*, 120*b* may also be attached at a plurality of vertical locations to the back support members 112*a*, 112*b*. Preferably, holes are drilled through the posts at different vertical locations to accommodate a bolt or screw from the ends 124*a*, 124*b* of the seat support members 106*a*, 106*b* and holes are drilled through the back support members 112*a*, 112*b* to accommodate a bolt or screw that extends from the upper end of the rear post 120*a*, 120*b*. Positioning a plurality of holes in these locations, allows the seat section 102 and attached back section 104 to be pivoted about the attachment point at the front of the seat section 102 to the front post 116 to thereby change the angle of the seat to accommodate different users.

Preferably, the seat section 102 and the back section 104 may be assembled by positioning the seat and back covering members 110, 114 between the seat and back support members 106*a*, 106*b*, 112*a*, 112*b*, respectively, in the manner as previously described. To complete assembly of the furniture assembly 100, the assembler may position the back support members 112*a*, 112*b* into the lap joint structures 115*a*, 115*b* of the seat support member 106*a*, 106*b* and then attach the ends 124*a*, 124*b* of the seat support members 106*a*, 106*b* to the rear posts 120*a*, 120*b* and also attach the rear posts 120*a*, 120*b* to the back support members 112*a*, 112*b*. The assembler may then attain the desired angled orientation of the seat section 102 and back section 104 with respect to the ground and uses the fasteners to secure the furniture assembly 100 in this position. By securing the furniture assembly 100 in this position, the piece of furniture 100 provides a great degree of flexibility with respect to adjusting the furniture assembly 100 to accommodate different users but still provides the high degree of support provided by the triangulated structures 117*a*, 117*b* in a manner as described above.

Figure 3:
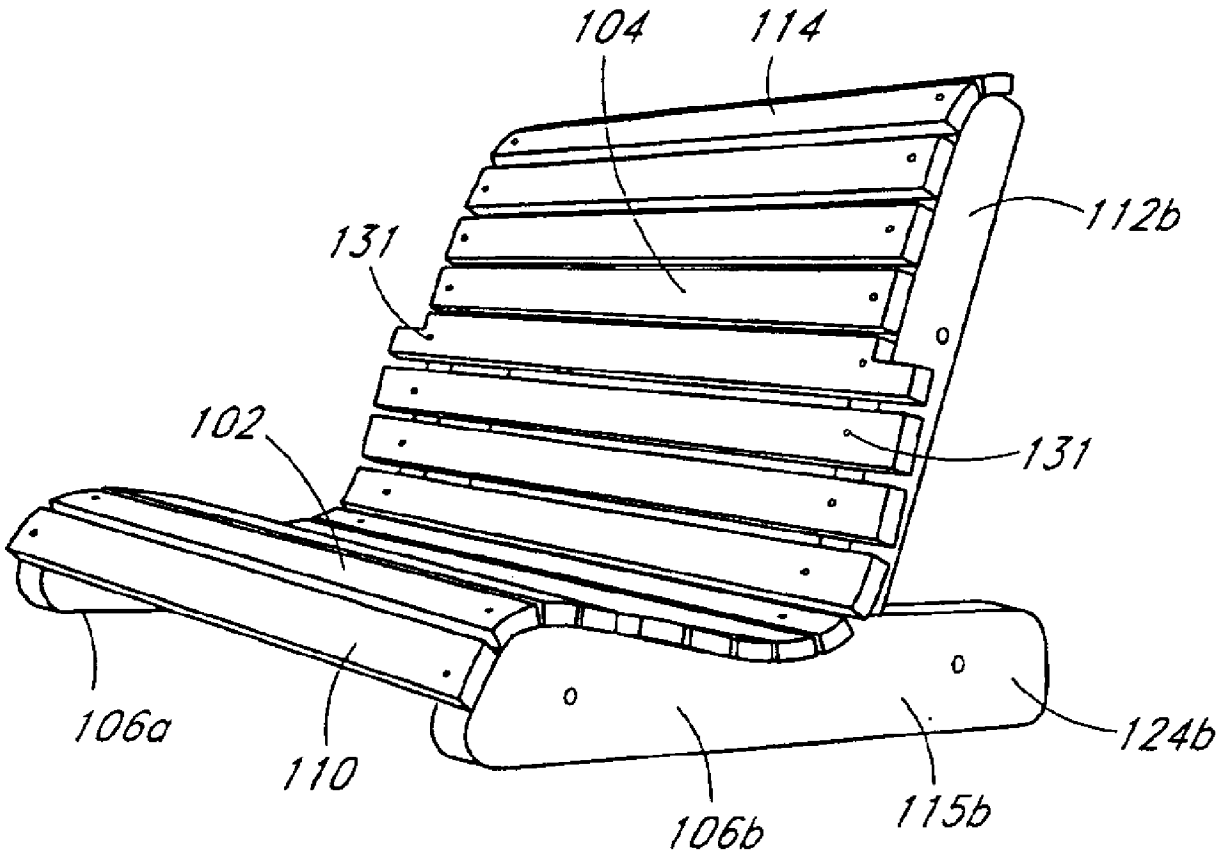
FIG. 3 is a perspective view of assembled seat and back sections of the furniture assembly of FIG. 1A.
Figure 4:
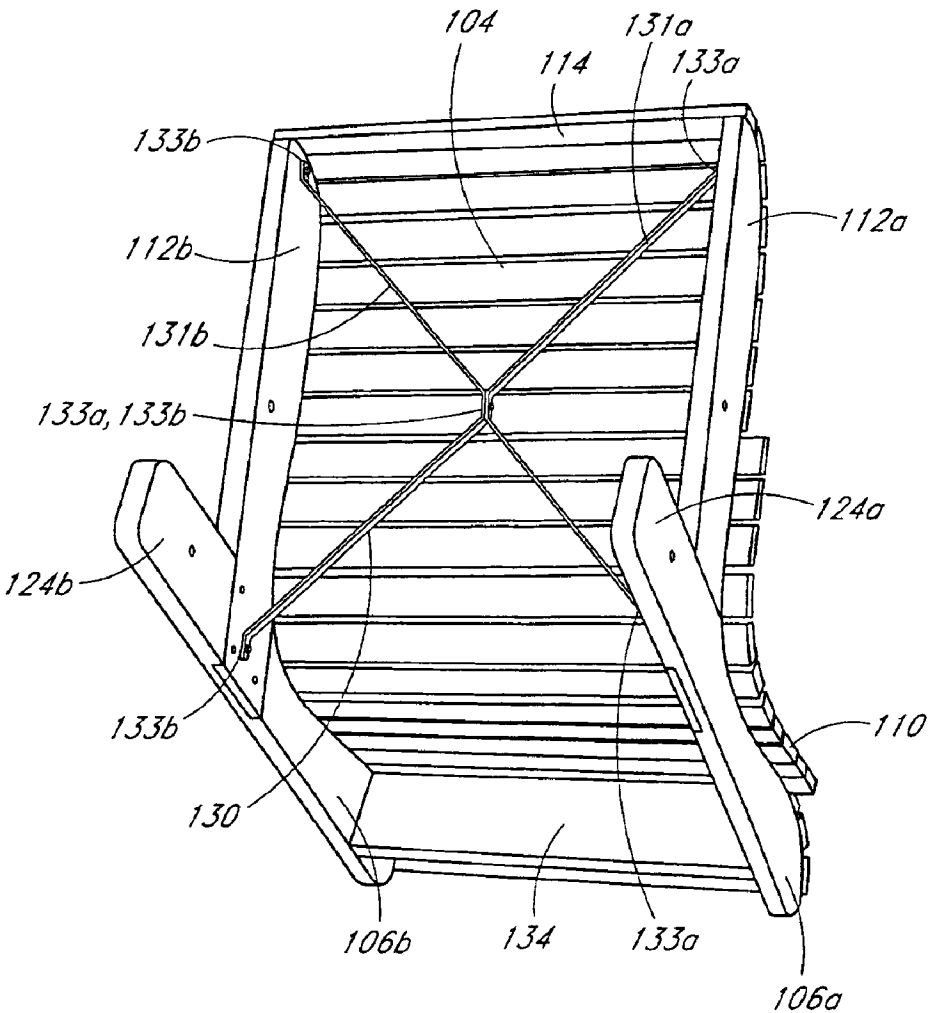
FIG. 4 is a rear view of assembled seat and back sections of the furniture assembly of FIG. 1A.

FIGS. 3 and 4 illustrate an assembled version of the seat and back sections 102, 104. The assembled versions of the seat and back sections 102, 104 in FIGS. 3, 4 are held together by the lap joint interconnections 115*a*, 115*b*, which are not yet fully engaged. It is simply illustrative of the manner in which these sections are temporarily interconnected. The seat and back sections 102, 104 in this embodiment have a plurality of substantially similar seat and back covering members 110, 114 that extend between the seat and back support members 106*a*, 106*b*, 112*a*, 112*b* so as to define a generally continuous surface.

In one aspect, the seat and back covering members 110, 114 are preferably attached to the seat support members 106*a*, 106*b* and back support members 112*a*, 112*b* in a known fashion using screws and/or bolts 131. As is also evidenced by FIG. 3, the front edge of the seat support members 106*a*, 106*b* is preferably curved such that the contour of the front edge of the seat section 102 is also curved which provides a more comfortable chair for the user. Similarly, the upper section of the back support members 112 is also curved such that when the back covering members 114 are positioned thereon, the surface of the chair at the upper end is also curved.

As is also illustrated in FIG. 4, further structural support may be provided using the metallic cross-brace 130 that may be mounted to the interior surfaces at four corners of the back support members 112*a*, 112*b* so as to define one embodiment of an x-shaped interlocking support structure. As is further illustrated in FIG. 4, the cross brace 130 is comprised of two generally v-shaped members 131*a*, 131*b*. In one aspect, the v-shaped members 131*a*, 131*b* define a flat section 133*a*, 133*b* at the apex of the v-shaped members 131*a*, 131*b* that abut each other when the v-shaped members 131*a*, 131*b* are mounted on the furniture assembly 100.

The flat sections 133*a*, 133*b* permit a nut and bolt assembly to be used to interconnect the two v-shaped members 131*a*, 131*b* which results in the v-shaped members being positioned within the same plane for compactness and structural support. This reinforces the back support members 112*a*, 112*b* and maintains a desired distance apart which inhibits the tendency of the back support members 112*a*, 112*b* of the furniture assembly 100 to warp, twist, or otherwise deform over time. It should be appreciated that a similar x-shaped support member may also be positioned on the bottom surface of the seat section 102 through attachment to the seat support members 106*a*, 106*b* in a similar manner. In this way, the tendency of components of the chair to warp over time due to exposure to weather may be further reduced.

In addition, the furniture assembly 100 may further comprise a crossbar support 134 that may be attached to the inner faces of the first and second seat support members 106*a*, 106*b* in a manner as illustrated in FIG. 4. The crossbar support 134 may also provides additional support for a seated individual sitting on the seat section 102 of the furniture assembly 100 in a manner so as to provide increased sideways stability.

Figure 5:
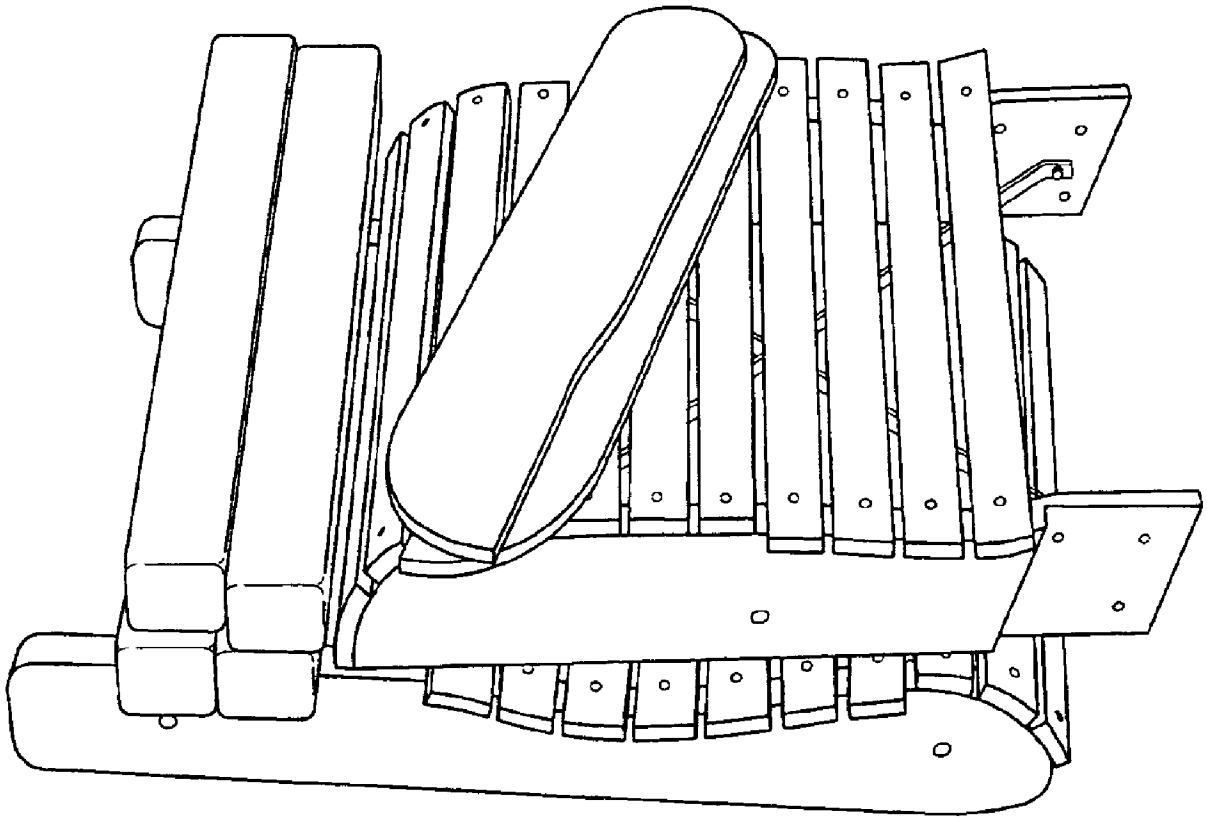
FIG. 5 is a disassembled view of the furniture assembly of FIG. 1A.

FIG. 5 illustrates all of the components of the furniture assembly 100 in a disassembled format. As is illustrated in FIG. 5, the back section 104 and seat section 102 may be separated from each other and may be positioned on top of one another for more compact shipment. Similarly, the front and rear posts 116*a*, 116*b*, 120*a*, 120*b* may also be detached and positioned on top of the assembled members along with the armrests 122*a*, 122*b* such that a single compact package may be formed which permits more efficient shipment of the furniture assembly 100. As is also illustrated in FIG. 5, a limited amount of hardware is needed to assemble the components of the furniture assembly 100 together. Advantageously, through the use of the predrilled holes, a furniture user may rapidly and easily assemble the chair and adjust it to the desired configuration without requiring specialized tools or specialized knowledge.

Figure 6A:
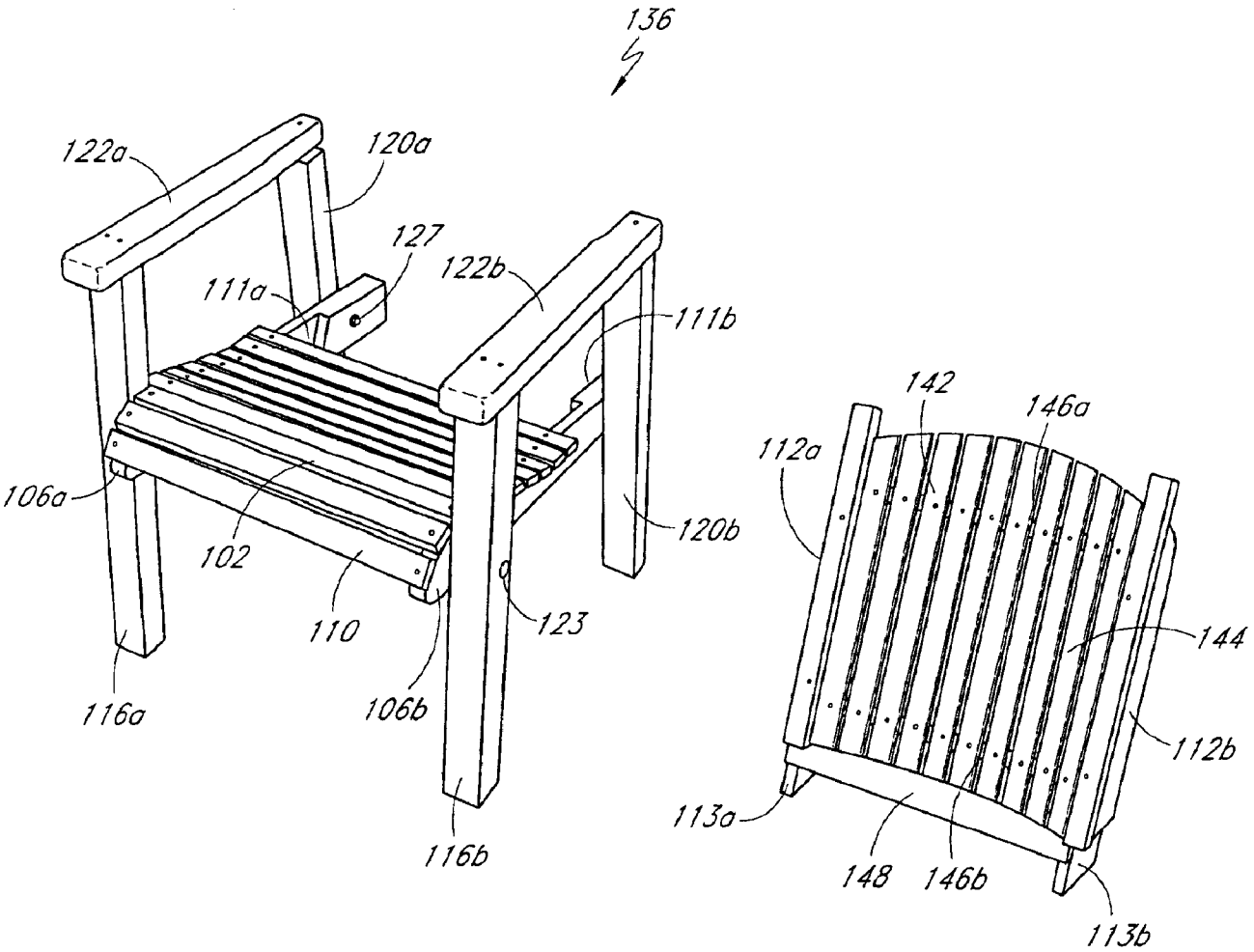
FIGS. 6A, 6B are perspective views illustrating an alternative embodiment of the furniture assembly of FIG. 1A having a modified back to achieve a different aesthetic appearance.
Figure 6B:
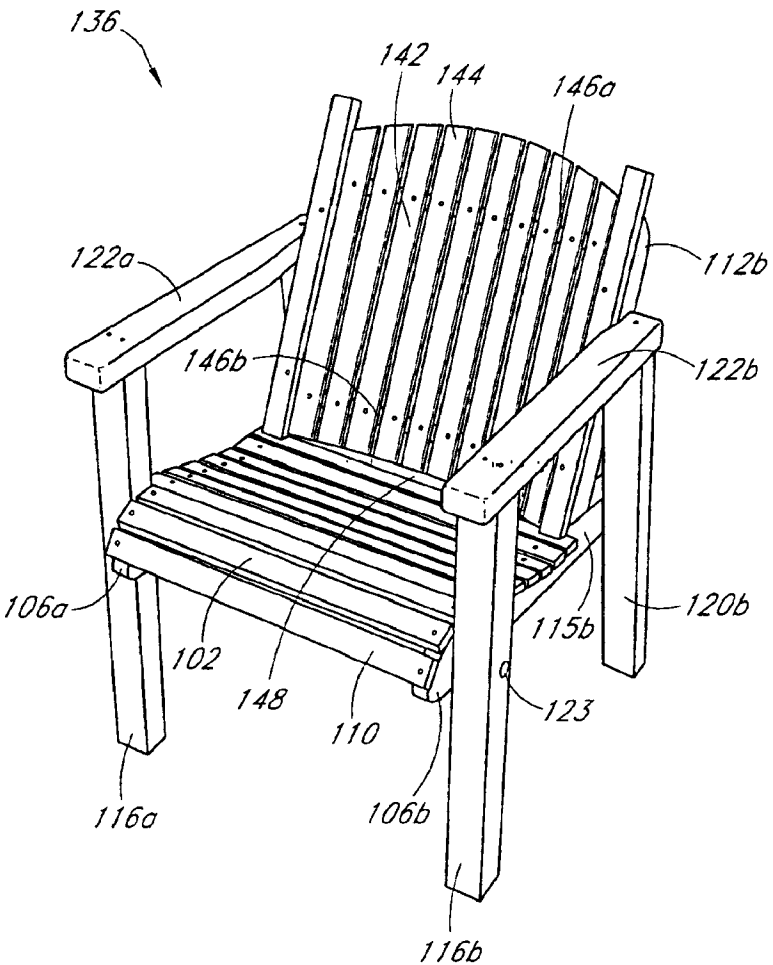

While FIGS. 1–5 illustrate one particular embodiment of the furniture assembly 100, it should be appreciated that slight modifications may be made to the furniture assembly 100 to achieve different aesthetic appearances without departing from the scope of the present invention. For example, FIGS. 6A, 6B illustrate another embodiment of a furniture assembly 136 having a different appearance, but the same basic structure of the furniture assembly 100 of FIG. 1A. In one aspect, a back section 142 of the furniture assembly 136 may configured to comprise back covering members 144 that extend in a vertical direction rather than a horizontal direction through the use of two horizontal attachment members 146*a*, 146*b* that extend between the back support members 112*a*, 112*b*. A lower cross support 148 may then be attached to the lower portion of the back section 142 to provide additional support for the furniture assembly 136. Moreover, the finish, dimensions, and contours of each of the various components of the furniture assembly 136 may be altered to achieve a different aesthetic appearance, or a different size, without departing from the scope of the present invention.

Figure 6C:
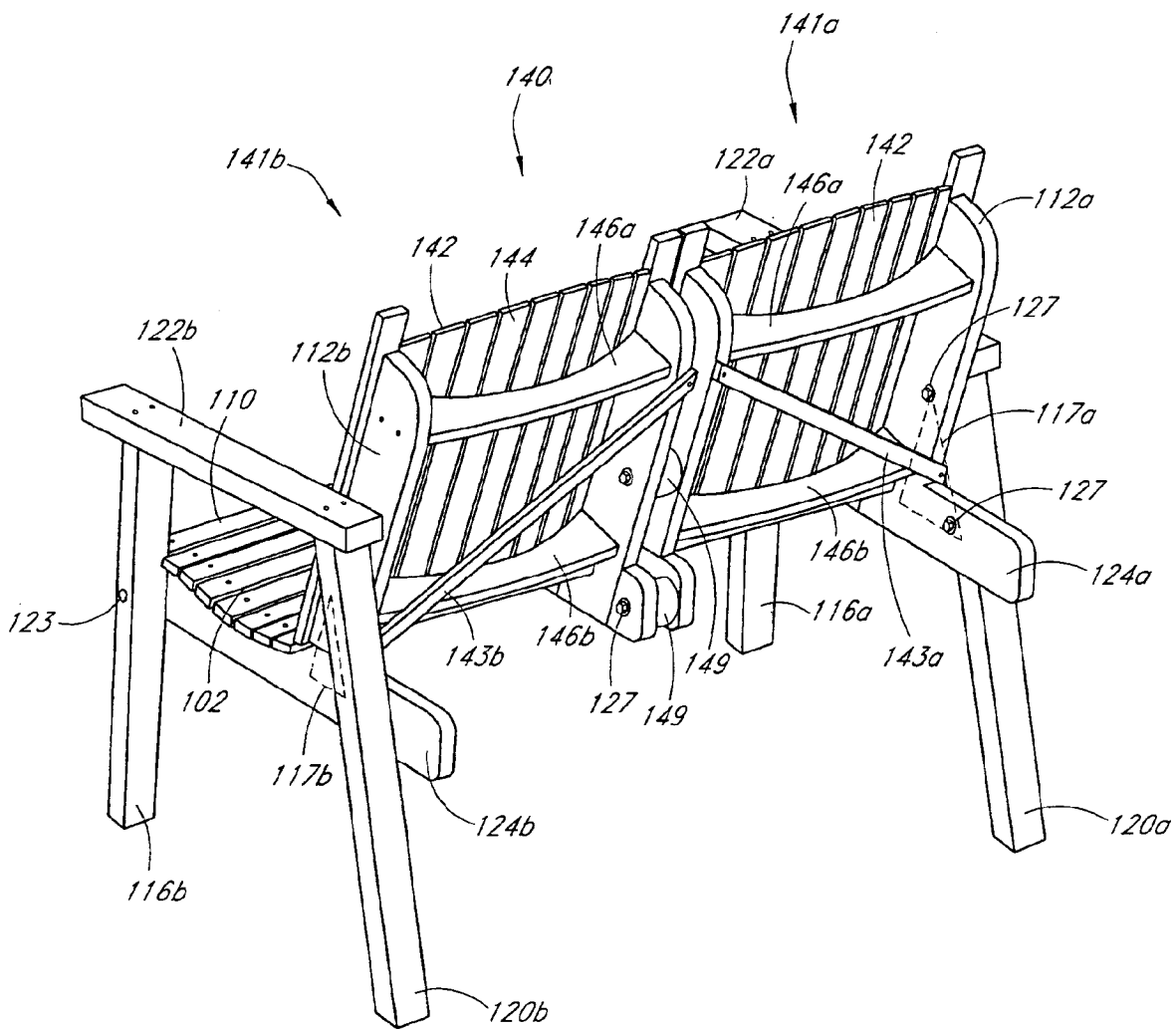
FIG. 6C illustrates one embodiment of a bench configuration of the furniture assemblies in FIGS. 1A–6B.

FIG. 6C illustrates one embodiment of a bench configuration 140 of the furniture assemblies 100, 136 in FIGS. 1A–6B. As illustrated in FIG. 6C, the bench configuration 140 positions at least two chair configured furniture assemblies 100, 136 adjacent one another so as to form bench seat and attaches the at least two chair configured furniture assemblies 100, 136 using one or more spacers 149 and bolts 127. In one aspect, a first chair assembly 141*a* may be positioned adjacent a second chair assembly 141*b* and attached so as to form the bench configuration 140. Additional angular supports 143*a*, 143*b* may be used to increase the downward strength of the bench assembly 140 for a seated individual sitting in the one or more seat sections 102. As illustrated in FIG. 6C, a first angular support 143*a* may be attached to the upper portion of the inner back support of the first chair assembly 141*a* and to the lower portion of the outer back support of the first chair assembly 141*a*. Similarly, a second angular support 143*b* may be attached to the upper portion of the inner back support of the second chair assembly 141*a* and to the lower portion of the outer back support of the second chair assembly 141*a*. In one aspect, the positional orientation of the first and second angular supports 141*a*, 141*b* resembles an A-frame structure that increases the strength of the bench configured furniture assembly 140 by supporting the load and downward force of one or more seated individuals.

It should be appreciated that two or more chair assemblies 100, 136 may be positioned and attached to one another in a similar manner as described herein so as to form the bench assembly 140 and/or an elongated bench assembly without departing from the scope of the present invention. It should also be appreciated that additional posts and/or legs may be attached to the bench assembly 140 for additional support by one skilled art without departing from the scope of the present invention.

Figure 7:
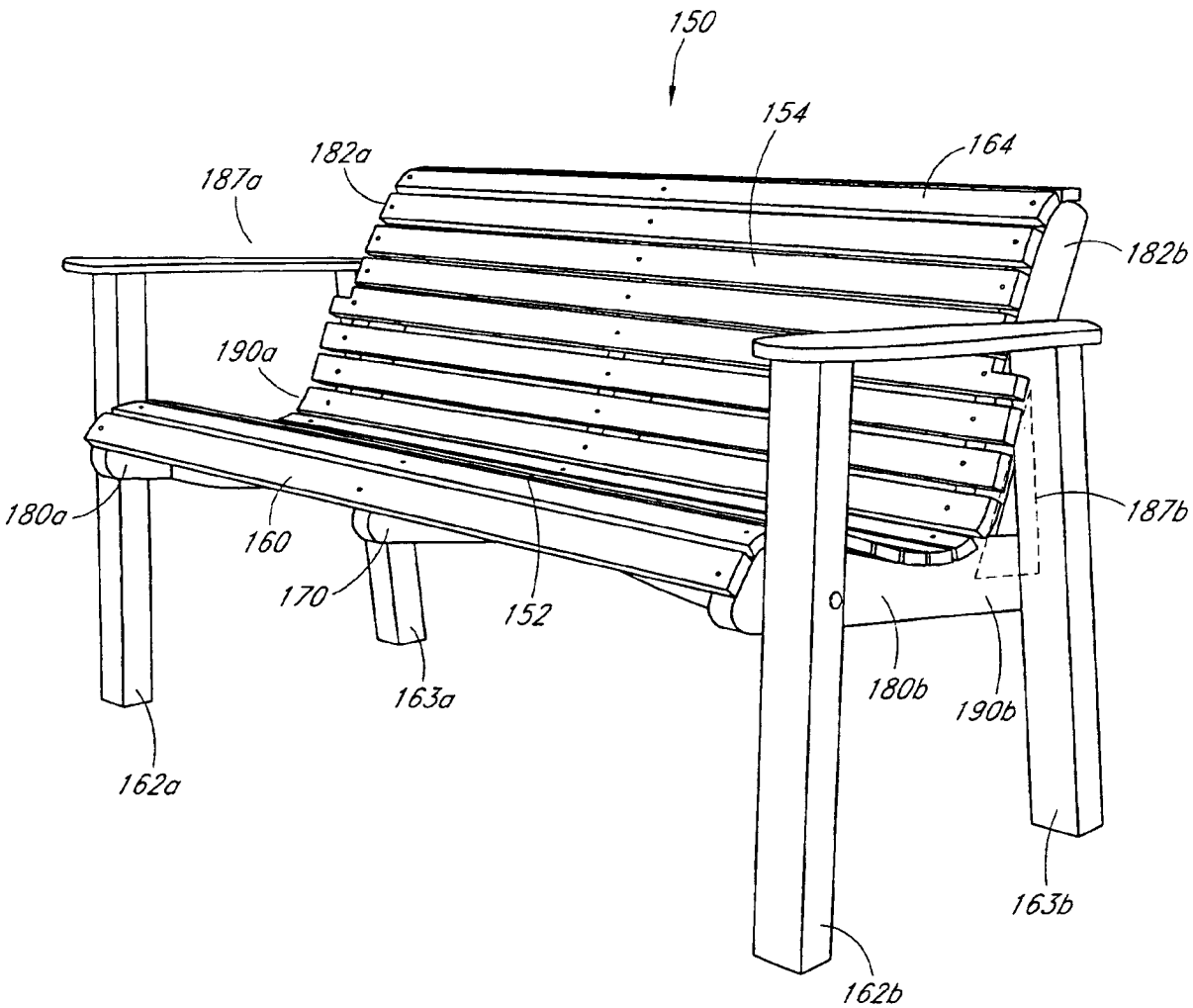
FIG. 7 is a front perspective view of a second embodiment of a furniture assembly similar to the furniture assembly of FIG. 1A, which is configured to form a bench.
Figure 8A:
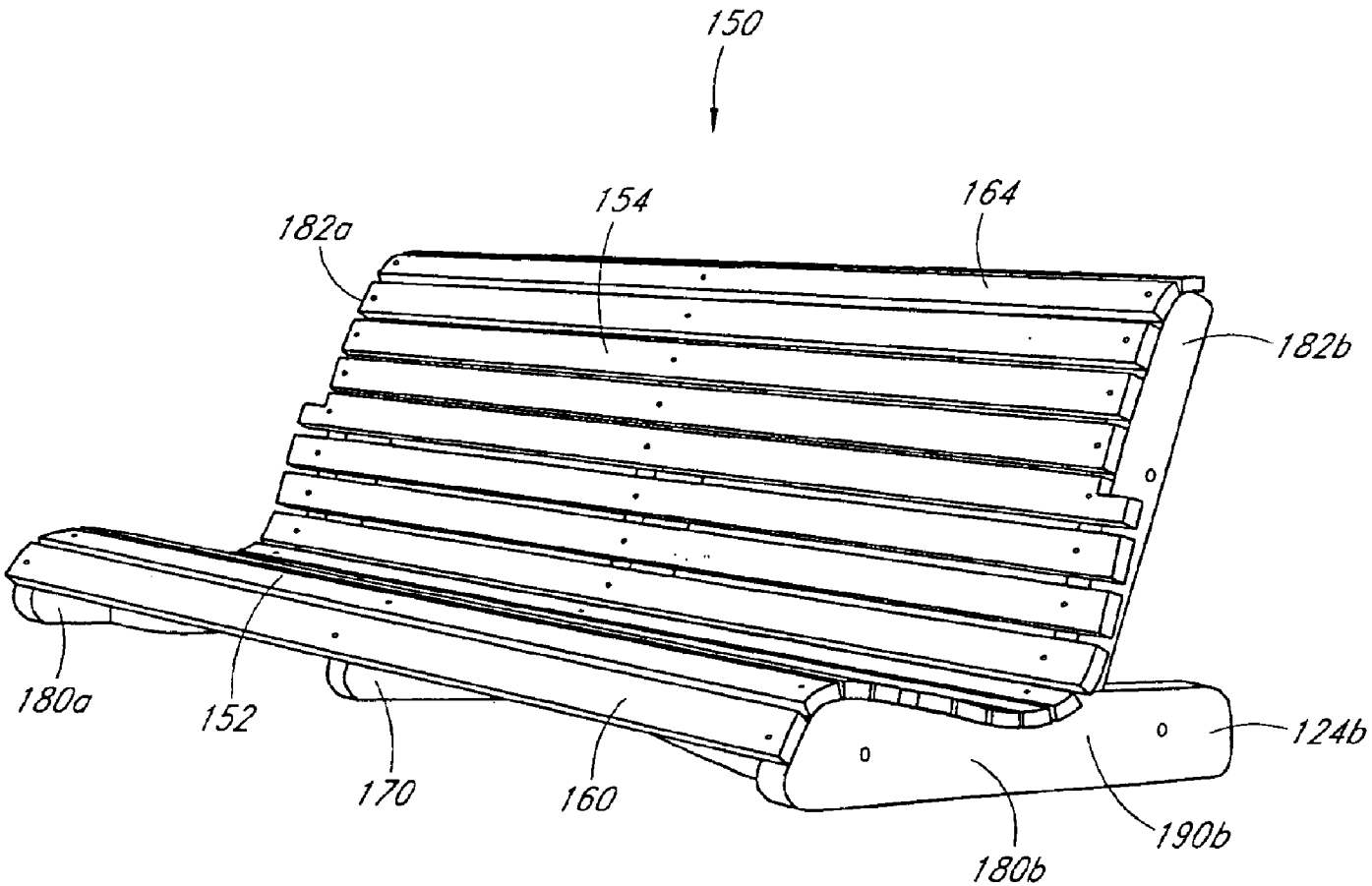
FIGS. 8A, 8B are perspective views illustrating assembled seat and back sections of the furniture assembly of FIG. 7.
Figure 8B:
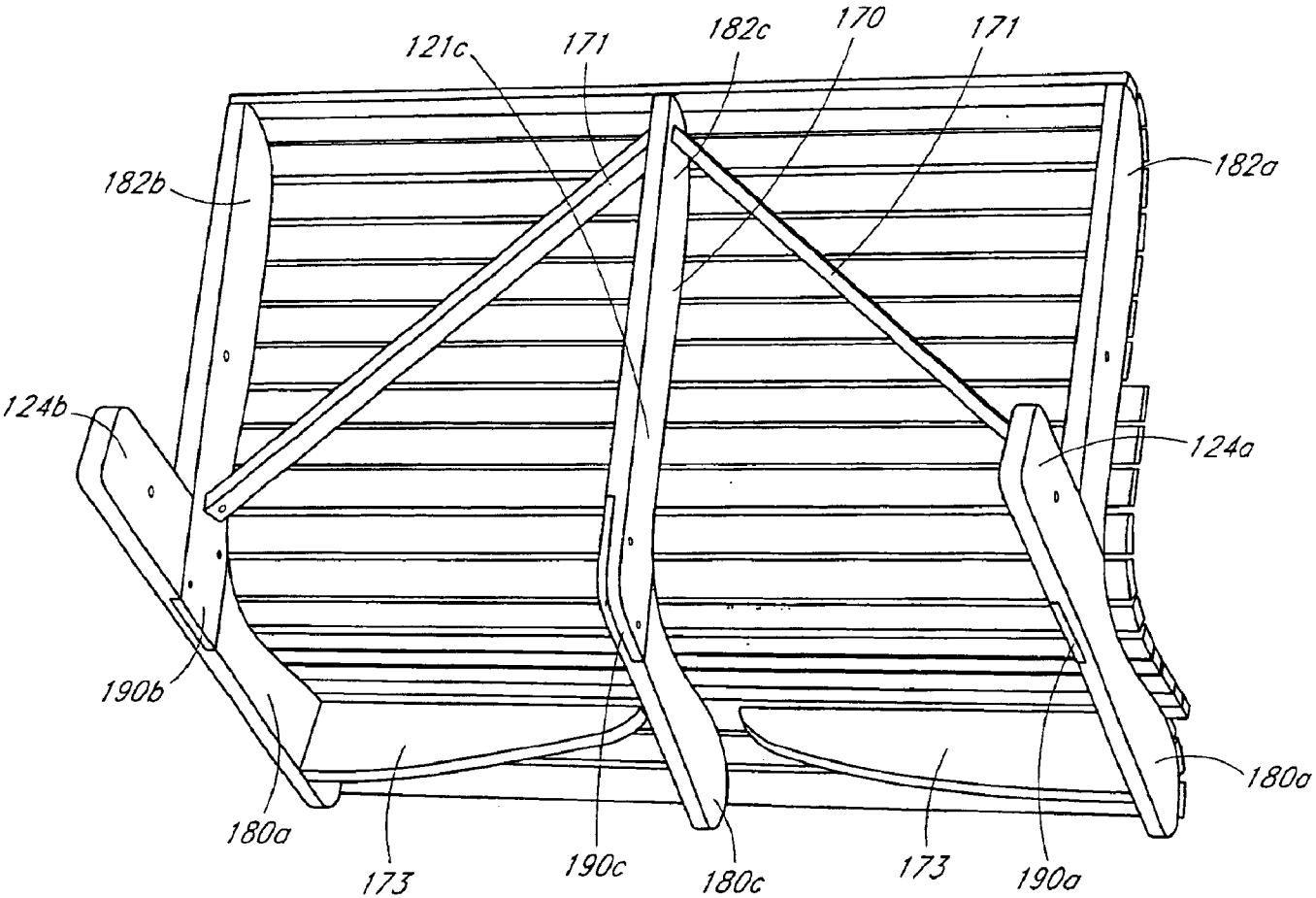
Figure 9:
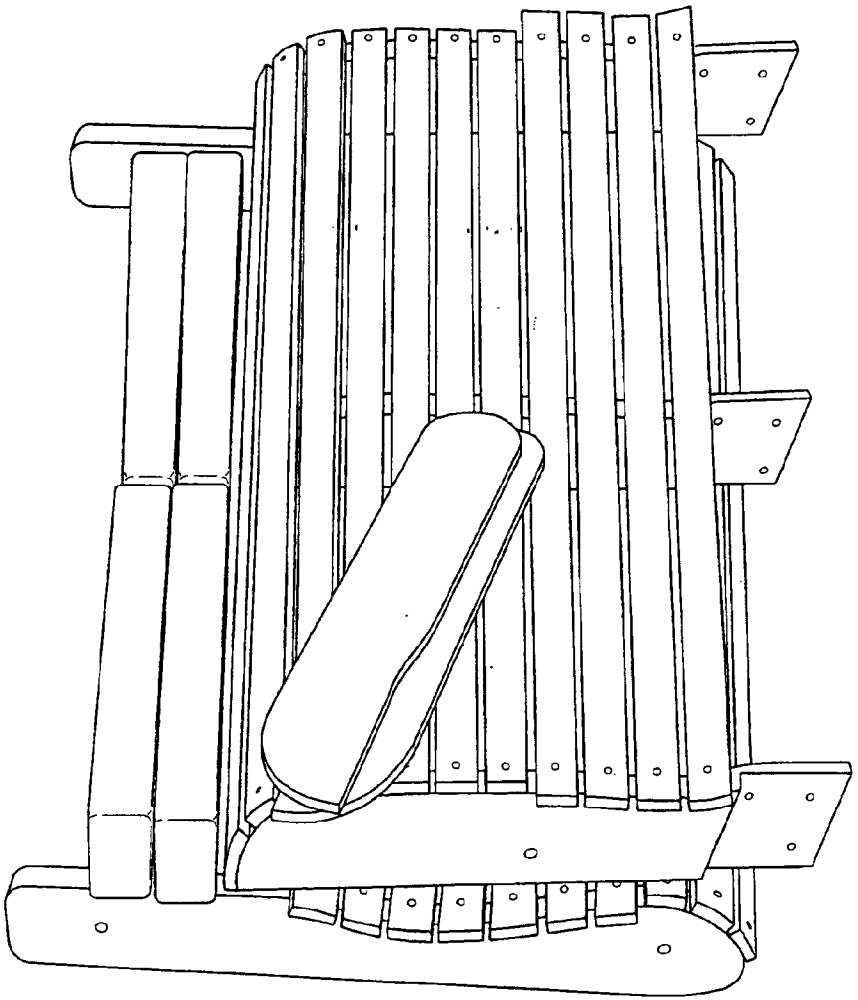
FIG. 9 is a disassembled view of the furniture assembly of FIG. 7.

FIGS. 7–9 illustrate yet another embodiment of a furniture assembly 150 of the present invention. The furniture assembly or modular bench 150 may comprise an elongated seat and back section 152, 154 and elongated seat and back covering members 160, 164, which may be interconnected so as to define a bench rather than a chair, such as the chair illustrated in FIGS. 1A–1C. As illustrated in FIG. 7, the modular bench 150 comprises at least four post legs 162*a*, 162*b*, 163*a*, 163*b* that may be configured to support the weight of one or more seated individuals sitting in the seat section 152.

Additionally, the elongated seat section 152 may comprise a plurality of seat support members 180*a*, 180*b*, wherein a first seat support member 180*a* is distally spaced from a second seat support member 180*b*. Also, the elongated back section 154 may comprise a plurality of back support members 182*a*, 182*b*, wherein a first back support member 182*a* may be attached to the first seat support member 180*a* in a manner so as to form a first lap joint interconnection 190*a*, and a second back support member 182*b* may be attached to the second seat support member 180*b* in a manner so as to form a second lap joint interconnection 190*b*. In one aspect, the plurality of elongated covering members 160, 164 may be mounted to an outer face of the seat and back support members 180*a*, 180*b*, 182*a*, 182*b* so as to extend therebetween to define a seat and back surface of the modular bench 150. Furthermore, the modular bench 150 may comprise at least one of a wood-based material and a metallic-based material.

Advantageously, the first and second lap joint interconnections 190*a*, 190*b* result in a fixed angular orientation between the seat support members 180*a*, 180*b* and the back support members 182*a*, 182*b* so as to form the modular bench 150 with enhanced strength and stability. When assembled, the modular bench 150 may also comprise the triangular support structures 187*a*, 187*b* as illustrated in FIGS. 1A–1C with reference to the triangular support structures 117*a*, 117*b* of the furniture (chair) assembly 100 so as to further enhance the modular bench 150 stability. In one aspect, the first back support member 182*a* may be attached to the first seat support member 180*a* and the first rear leg 163*a* in a manner so as to form a first triangulated interconnection 187*a*. Similarly, the second back support member 182*b* may be attached to the second seat support member 180*b* and the second rear leg 163*b* in a manner so as to form a second triangulated interconnection 187*b*, and wherein the first and second triangulated interconnections 187*a*, 187*b* result in a fixed angular orientation between the seat support members 180*a*, 180*b* and the back support members 182*a*, 182*b* so as to form the modular bench 150 with improved structural stability.

In one embodiment, at least two of the at least four legs 162*a*, 162*b*, 163*a*, 163*b* may comprise first and second front post legs 162*a*, 162*b* that may be respectively pivotally attached to the front ends of the first and second seat support members 180*a*, 180*b* such that the seat support members 180*a*, 180*b* pivot with respect to the first and second front post legs 162*a*, 162*b*. Additionally, at least two of the at least four legs 162*a*, 162*b*, 163*a*, 163*b* may comprise first and second rear post legs 163*a*, 163*b* that may be attached to the extending ends of the first and second seat support members 180*a*, 180*b* and also attached to an outer surface of the first and second back support members 182*a*, 182*b*. It should be appreciated that the triangulated support structures 187*a*, 187*b* may be defined by the attachment of the seat support members 180*a*, 180*b*, the back support members 182*a*, 182*b*, and the rear post legs 163*a*, 163*b* in a manner so as to further enhance strength and stability for the modular bench 150. Moreover, the front and rear post legs may be installed in an angular manner with respect to the ground to provide additional forward and backward stability.

It should also be appreciated that the extending ends of the seat support members 180*a*, 180*b* and the upper ends of the rear post legs 163*a*, 163*b* may be attached to the seat and back support members 180*a*, 180*b*, 182*a*, 182*b* along a plurality of locations. In this particular embodiment, the seat and back sections 152, 154 of the modular bench 150, as defined by the respective support members, may be pivoted with respect to the front posts 162*a*, 162*b* such that the modular bench 150 may be assembled in one of a plurality of different orientations. in addition, the modular bench 150 may further comprise a pair of arm supports 186*a*, 186*b* that extend between the upper surface of both the front and rear post legs 162*a*, 162*b*, 163*a*, 163*b*, which may inhibit the front post legs 162*a*, 162*b* from pivoting, thereby restraining the front post legs 162*a*, 162*b* at a fixed position relative to the ground. Advantageously, the modular bench 150, when assembled, is sturdy and be assembled into the plurality of different orientations to accommodate one or more individuals.

As illustrated in FIGS. 8A, 8B, the mid-support structure 170 may be configured to comprise an L-shaped support member having substantially the same configuration as the interconnected seat and back support members 180*a*, 180*b*, 182*a*, 182*b* except that it does not define the seat support member ends 124*a*, 124*b*. The mid-support member 170 may comprise a third seat member 180*c* and a third back support member 182*c* that may be attached in a manner to form a third lap joint interconnection 190*c*. Advantageously, the seat and back covering members 160, 164 may be interconnected to the mid-support structure 170 so that the seat and back covering members 160, 164 function as a single structural unit such that the tendency of the seat and back covering members 160, 164 to sag when people sit in the middle of the bench is reduced. Moreover, one or more back braces 171 may extend from the upper ends of the third back support 182*c* of the mid-support structure 170 to the lower ends of the first and second back support members

182*a*, 182*b* in a manner as illustrated in FIG. 8B. Similarly, as illustrated in FIG. 8B, one or more seat brace structures 173 may also extend from the inner face of the front portion of the first and second seat support members 180*a*, 180*b* towards the inner faces of the third seat support member 180*c* of the mid-support structure 170 in a substantially perpendicular direction so as to provide further structural support for the seat section 152 of the modular bench 150.

Additionally, each of the brace members 171, 173 may comprise wooden members that may be bolted or screwed in a known manner to the various component pieces to thereby provide additional structural support to the mid-support structure 170 and the furniture assembly 150. As is also illustrated in FIG. 9, the furniture assembly 150 may also be disassembled for ease of shipping in a manner similar to the manner described above in connection with the piece of furniture illustrated in FIGS. 1–5. In one aspect, the modular bench 150 may be readily disassembled for ease of shipment or storage by removing the back support members 182*a*, 182*b*, 182*c* from the seat support members 180*a*, 180*b*, 180*c* such that the resulting pieces are planar pieces of the modular bench 150 that may be stacked on top of each other as illustrated in FIG. 9. In addition, the front and rear post legs 162*a*, 162*b*, 163*a*, 163*b* may also be removed from the modular bench 150 after removing the back support members 182*a*, 182*b*, 182*c* from the seat support members 180*a*, 180*b*, 180*c* so as to be able to be stacked on the seat and back sections 152, 154 of the modular bench 150 as illustrated in FIG. 9.

It should be appreciated that the design for the furniture (bench) assembly 150 may be modified such that it may be formed with the same basic structures of the furniture (chair) assembly 100 as illustrated in FIGS. 1–6. In particular, the mid-support structure 170 may be replaced by one or more interconnected seat and back support members 106, 112. In one particular implementation, two seat support members 106 may be positioned adjacent each other and then interconnected so as to provide the mid-bench support. Hence, the basic hardware needed to manufacture the furniture (chair) assembly 100 may also be used to manufacture the furniture (bench) assembly 150 without departing from the scope of the present invention. It should also be appreciated that the modular bench 150 may further comprise a horizontally extending back section or member that extends between the first and second seat support members 180*a*, 180*b* at the rear of the first and second seat support members 180*a*, 180*b* such that back surface members may be extended in a direction perpendicular to the ground to achieve a different aesthetic appearance of the modular bench 150 as illustrated in FIGS. 6A, 6B with reference to furniture (chair) assembly 136.

In one aspect, the configuration of the seat support members 180*a*, 180*b* and the back support members 182*a*, 182*b* define triangulated interconnections 187*a*, 187*b* to the rear posts 120*a*, 120*b* with a similar scope and functionality as described above with reference to the furniture assembly 100 of FIGS. 1–5. However, as is illustrated in FIG. 8B, using an elongated seat and back covering members 160, 164 may result in the need for additional seat and back support members 180*c*, 182*c* and a mid-support structure 170 as illustrated with reference to FIG. 8B. The third seat support member 180*c* may be attached to the third back support member 182*c* so as to form a third support component 121*c*. The third support component 121*c* may be attached to the elongated seat and back covering members 152, 154.

Therefore, the elongated seat section 152 may further comprise a third seat support member 180*c* that may be positioned between the first and second seat support members 180*a*, 180*b* so as to provide increased support for a seated individual. Similarly, the elongated back section 154 may further comprise a third back support member 182*c* that may be positioned between the first and second back support members 182*a*, 182*b* so as to provide increased support for a seated individual. In addition, the third seat support member 180*c* may be attached to the third back support member 182*c* so as to form a third lap joint interconnection 190*c*, as illustrated in FIG. 8B, that may be used to further enhance the strength and stability of the modular bench 150. Advantageously, the fixed angular orientation developed between by lap joint interconnection of the seat support members 180*a*, 180*b*, 180*c* and the back support members 182*a*, 182*b*, 182*c* may enhance lateral and/or sideways stability.

From the foregoing, it will be appreciated that the various embodiments of the furniture assembly 100, 136, 150 are structurally quite sound as a result of the lap joint interconnections 115*a*, 115*b*, 190*a*, 190*b*, 190*c* and the triangulated interconnection structures 117*a*, 117*b*, 187*a*, 187*b*. In addition, the furniture assemblies 100, 136, 150 may be adjustably assembled to accommodate the likes and desires of different users. Furthermore, the furniture assemblies 100, 136, 150 of the preferred embodiments may be disassembled, as illustrated with reference to FIGS. 5, 9, to permit more efficient storage, packaging, and shipping.

With reference to the furniture (chair) assembly 100, it should be further appreciated that the interconnection of the seat support members 106*a*, 106*b*, 106*c* the back support members 112*a*, 112*b*, 112*c* and rear posts 120*a*, 120*b* and the use of the seat and back covering members 110, 114, 160, 164 results in a structure that inhibits movement in all directions. In particular, the interconnection of the rear posts 120*a*, 120*b* to the seat support members 106*a*, 106*b* and the back support member 112*a*, 112*b* inhibit the seat section 102 and the back section 104 from falling or moving vertically.

Moreover, the use of the lap joint interconnections 115*a*, 115*b* between the seat support members 106*a*, 106*b*, 106*c* and the back support members 112*a*, 112*b*, 112*c* further inhibits the back support from falling. The interconnection of the seat members 110, 106*a*, 106*b*, 106*c*, 143, 160 and the back members 112*a*, 112*b*, 112*c*, 114, 141, 164 inhibit lateral movement of the front and/or rear posts 116*a*, 116*b*, 120*a*, 120*b* as these posts are attached to the seat and back support members 106*a*, 106*b*, 106*c*, 112*a*, 112*b*, 112*c* such that the seat and back covering members 110, 114, 160, 164 maintain the seat and back support members 106*a*, 106*b*, 106*c*, 112*a*, 112*b*, 112*c* at a specific distance apart from each other.

Furthermore, the use of the lap joint interconnection 115*a*, 115*b* and the triangular interconnections 117*a*, 117*b* further provides greater sideways or lateral stability for the piece of furniture without requiring significantly greater numbers of fasteners. Thus, a piece of furniture that is very stable is achieved with the use of fewer fasteners due to the structural interconnection of the components. It should be appreciated that the advantages described herein with reference to the furniture (chair) assembly 100 may also be applied to the furniture (bench) assembly 150.

Although the following description exemplifies one embodiment of the present invention, it should be understood that various omissions, substitutions, and changes in the form of the detail of the apparatus, system, and method as illustrated as well as the uses thereof, may be made by those skilled in the art, without departing from the scope of the present invention. Consequently, the scope of the present invention should not be limited to the disclosed embodiments, but should be defined by the appended claims.

What is claimed is:

1. A furniture assembly comprising:

a first and second seat support member;

a first and second back support member that are attached by a lap joint to the first and second seat support members at a midpoint such that first and second ends of the seat support members extend behind the back support members, wherein the lap joint results in a fixed angular orientation between the seat support members and the back support members so as to provide increased structural stability;

a plurality of covering members that are mounted to an outer face of the first and second seat support members and the first and second back support members so as to extend therebetween to define the seat and back surface of the furniture assembly;

a first and second front post that are respectively pivotally attached to the front ends of the first and second seat support members such that the seat support members can pivot with respect to the first and second front posts; and a first and second rear post that are attached to the extending ends of the first and second seat support members and are also attached to an outer surface of the first and second back support members.

2. The furniture assembly of claim 1, wherein the furniture assembly is assembled so to define a chair.

3. The furniture assembly of claim 1, wherein the seat and back support members are provisionally connected before the plurality of covering members are attached, and wherein the provisional attachment is removed following installation of the seat and back covering members, which provide sideways support.

4. The furniture assembly of claim 1, wherein at least one triangulated structure is defined by the attachment of the extended seat support members, the back support members, and the rear posts in a manner so as to provide additional support and stability for the furniture assembly.

5. The furniture assembly of claim 1, wherein the extending ends of the seat support members and the upper ends of the rear post can be attached to the seat support members and the back support members along a plurality of locations, which allows the seat and back section of the furniture assembly, as defined by the respective support members, to be pivoted with respect to the front posts such that the furniture assembly can be assembled in one of a plurality of different orientations.

6. The furniture assembly of claim 1, wherein the furniture assembly further comprises a pair of arm supports that extend between the upper surface of both the front and rear posts which also results in the front posts being inhibited from pivoting, thereby restraining the front posts at a fixed position relative to the ground.

7. The furniture assembly of claim 1, wherein the furniture assembly further comprises at least one horizontally extending back member that extends between the first and second back support members at the rear of the first and second back support members, and wherein the covering members are attached to the first and second back support members so as to extend in a direction substantially perpendicular to the ground.

8. The furniture assembly of claim 1, wherein the furniture assembly is elongated with a center support structure so as to define a bench.

9. The furniture assembly of claim 1, wherein two or more furniture assemblies are interconnected so as to from a bench.

10. The furniture assembly of claim 1, wherein the furniture assembly can be disassembled for shipment or storage by removing the back support members from the seat support members such that the two resulting pieces are two planar pieces of the furniture assembly that can be stacked on top of each other.

11. The furniture assembly of claim 10, wherein the front and rear posts can be removed from the furniture assembly after removing the back support members from the seat support members so as to be able to be stacked on the seat and back sections of the furniture assembly.

12. A furniture assembly defining a chair, the furniture assembly comprising:

a seat section having seat support members;

at least four legs attached to the seat section;

a back section having back support members attached to at least two of the at least four legs, wherein the back support members are attached to the seat support members in a manner so as to define a lap joint interconnection, and wherein the lap joint interconnection defines a cut out and a ledge that results in the back support members resting on the seat support members so as to inhibit downward movement, and wherein the lap joint interconnection provides for a fixed angular relationship between the back support members and the seat support members that locks to the backrest so as to inhibit unstable sideways stability; and a triangulated structure that is defined by the attachment of the extended seat support members, the back support members, and at least two of the at least four legs in a manner so as to provide additional support and strength for the furniture assembly.

13. The furniture assembly of claim 12, wherein the furniture assembly further comprises a plurality of covering members that are mounted to an outer face of the first and second seat support members and the first and second back support members so as to extend therebetween to define the seat and back surface of the furniture assembly.

14. The furniture assembly of claim 13, wherein the seat and back support members are provisionally connected before the plurality of covering members are attached, and wherein the provisional attachment is removed following installation of the seat covering members which provide the sideways support.

15. The furniture assembly of claim 13, wherein the furniture assembly further comprises at least one horizontally extending back member that extends between the first and second back support members at the rear of the first and second back support members, and wherein the covering members are attached to the first and second back support members so as to extend in a direction substantially perpendicular to the ground.

16. The furniture assembly of claim 12, wherein at least two of the at least four legs comprise a first and second front post that are respectively pivotally attached to the front ends of the first and second seat support members such that the seat support members can pivot with respect to the first and second front posts.

17. The furniture assembly of claim 16, wherein at least two of the at least four legs comprise a first and second rear post that are attached to the extending ends of the first and second seat support members and are also attached to an outer surface of the first and second back support members.

18. The furniture assembly of claim 17, wherein the extending ends of the seat support member and the upper ends of the rear post can be attached to the seat support members and the back support members along a plurality of locations, which allows the seat and back section of the furniture assembly, as defined by the respective support members, to be pivoted with respect to the front posts such that the furniture assembly can be assembled in one of a plurality of different orientations.

19. The furniture assembly of claim 18, wherein the furniture assembly further comprises a pair of arm supports that extend between the upper surface of both the front and rear posts, which also results in the front posts being inhibited from pivoting.

20. The furniture assembly of claim 12, wherein the furniture assembly is elongated with a center support structure so as to define a bench.

21. The furniture assembly of claim 12, wherein two or more furniture assemblies are interconnected so as to from a bench.

22. The furniture assembly of claim 12, wherein the furniture assembly can be disassembled for shipment or storage by removing the back support members from the seat support members such that the resulting pieces of the furniture assembly are planar pieces of the furniture assembly that can be stacked on top of each other.

23. The furniture assembly of claim 22, wherein the at least four legs can be removed from the furniture assembly after removing the back support members from the seat support members so as to be able to be stacked on the seat and back sections of the furniture assembly.

24. A modular bench comprising:

an elongated seat section having a plurality of seat support members with at least one recessed region, wherein a first seat support member is distally spaced from a second seat support member;

at least four legs attached to the elongated seat section; and an elongated back section having a plurality of back support members with at least one slotted region, wherein a first back support member is attached to the first seat support member in a manner so as to form a first lap joint interconnection between the recessed region and the slotted region, and wherein and a second back support member is attached to the second seat support member in a manner so as to form a second lap joint interconnection between the recessed region and the slotted region, and wherein the first and second lap joint interconnections result in a fixed angular orientation between the seat support members and the back support members so as to form the modular bench with enhanced strength and stability.

25. The modular bench of claim 24, wherein the elongated seat section further comprises a third seat support member that is positioned between the first and second seat support members.

26. The modular bench of claim 25, wherein the elongated back section further comprises a third back support member that is positioned between the first and second back support members.

27. The modular bench of claim 26, wherein the third seat support member is attached to the third back support member so as to form a third lap joint interconnection that is used to further enhance the strength and stability of the modular bench.

28. The modular bench of claim 24, wherein the modular bench further comprises a plurality of elongated covering members that are mounted to an outer face of the seat support members and the back support members so as to extend therebetween to define the seat and back surface of the modular bench.

29. The modular bench of claim 24, wherein at least two of the at least four legs comprise first and second front post legs that are respectively pivotally attached to the front ends of the first and second seat support members such that the seat support members can pivot with respect to the first and second front post legs.

30. The modular bench of claim 29, wherein at least two of the at least four legs comprise first and second rear post legs that are attached to the extending ends of the first and second seat support members and are also attached to an outer surface of the first and second back support members.

31. The modular bench of claim 30, wherein at least one triangulated support structure is defined by the attachment of the extended seat support members, the back support members, and the rear post legs in a manner so as to further enhance strength and stability for the modular bench.

32. The modular bench of claim 31, wherein the extending ends of the seat support member and the upper ends of the rear post legs can be attached to the seat support members and the back support members along a plurality of locations, which allows the seat and back section of the modular bench, as defined by the respective support members, to be pivoted with respect to the front posts such that the modular bench can be assembled in one of a plurality of different orientations.

33. The modular bench of claim 32, wherein the modular bench further comprises a pair of arm supports that extend between the upper surface of both the front and rear post legs which also results in the front post legs being inhibited from pivoting, thereby restraining the front post legs at a fixed position relative to the ground.

34. The modular bench of claim 28, wherein the modular bench further comprises one or more horizontally extending back members that are configured to extend between the first and second back support members at the rear of the first and second back support members, and wherein the covering members are attached to the first and second back support members so as to extend in a direction substantially perpendicular to the ground.

35. The modular bench of claim 24, wherein the modular bench can be disassembled for shipment or storage by removing the back support members from the seat support members such that the resulting pieces are planar pieces of the modular bench that can be stacked on top of each other.

36. The modular bench of claim 35, wherein the at least four legs can be removed from the modular bench after removing the back support members from the seat support members so as to be able to be stacked on the seat and back sections of the modular bench.

* * * * *